United States Patent [19]

Vukasovich et al.

[11] Patent Number: 5,000,916

[45] Date of Patent: Mar. 19, 1991

[54] MOLYBDATE-GLUCONATE CORROSION INHIBITOR

[75] Inventors: Mark S. Vukasovich, Ann Arbor, Mich.; Roger F. Sebenik, Boulder, Colo.

[73] Assignee: Amax Inc., New York, N.Y.

[21] Appl. No.: 380,835

[22] Filed: Jul. 17, 1989

[51] Int. Cl.[5] ..... C23F 11/00; C23F 11/10; C07F 11/00; C09K 3/00

[52] U.S. Cl. ..... 422/14; 422/7; 422/17; 422/19; 556/57; 556/61; 556/62; 252/387; 252/389.54

[58] Field of Search ..... 422/14, 17, 19, 7; 556/57, 61, 62; 252/387, 389.54

[56] References Cited

U.S. PATENT DOCUMENTS

| | | | |
|---|---|---|---|
| 3,589,859 | 6/1971 | Foroulis | 422/17 |
| 4,313,837 | 2/1982 | Vukasovich | 252/387 |
| 4,349,457 | 9/1982 | Orillion | 422/7 |
| 4,512,552 | 4/1985 | Katayama et al. | 252/389.51 |
| 4,806,310 | 2/1989 | Mullins et al. | 252/389.54 |

*Primary Examiner*—Robert J. Warden
*Assistant Examiner*—Thalia P. Vassilatos
*Attorney, Agent, or Firm*—Michael A. Ciomek; Eugene J. Kalil

[57] ABSTRACT

Directed to a new molybdenum carboxylic compound and the use thereof as a corrosion inhibitor of steel and other metals particularly in cooling water.

9 Claims, 4 Drawing Sheets

MOLYBDATE-GLUCONATE CORROSION INHIBITOR

The invention relates to the synthesis and utilization of a novel corrosion inhibitor which is the economical reaction product of molybdic oxide with a suitable carboxylate salt. Moreover, the inventive molybdate-gluconate complexes afford effective inhibition of the corrosion problem known as scaling.

BACKGROUND OF THE INVENTION

Water is the best known corrosive agent causing rapid corrosion, either directly or indirectly, of most types of metallic surfaces, especially those of iron or iron alloys such as steel. Therefore, protection or resistance against corrosion from water and water-soluble corrosive reactants has been a primary concern of research and development, concomitant with the universal utilization of metallic, particularly, iron containing materials.

Both molybdate and carboxylate compounds are known in the art to act as rust and other corrosion preventatives. These carboxylates are typically salts of mono-, di-, or tribasic alkyl or aryl acids. Gluconates, for example, have been well recognized as masking or sequestering compounds tending to form organic complexes with iron and aluminum in near neutral solutions as well as with calcium in alkaline media. Thus, sodium gluconate, zinc gluconate, blends of alkali metal gluconate and sodium gluconate have been found useful as corrosion inhibitors of mild steel.

It has been proposed that carboxylates such as gluconate inhibit steel corrosion by forming a protective, i.e., hydrophobic layer in the form of insoluble iron carboxylate complexes whereby an $Fe^{3+}$ state is maintained by dissolved oxygen. Indeed, numerous carboxylate compounds are described in the literature on cooling water, metal working fluids, or antifreeze, etc. as being inhibitors of ferrous metal corrosion.

We have made the surprising discovery that the present novel organomolybdenum compounds exhibit unexpected efficacy as corrosion inhibitors compared to conventional agents in immersion or gravimetric and electrochemical tests. Moreover, the novel compounds have exhibited advantageous physical and chemical properties such as high stability in concentrated storage solutions and good resistance to sunlight and heat effects.

SUMMARY OF THE INVENTION

Figure 1:
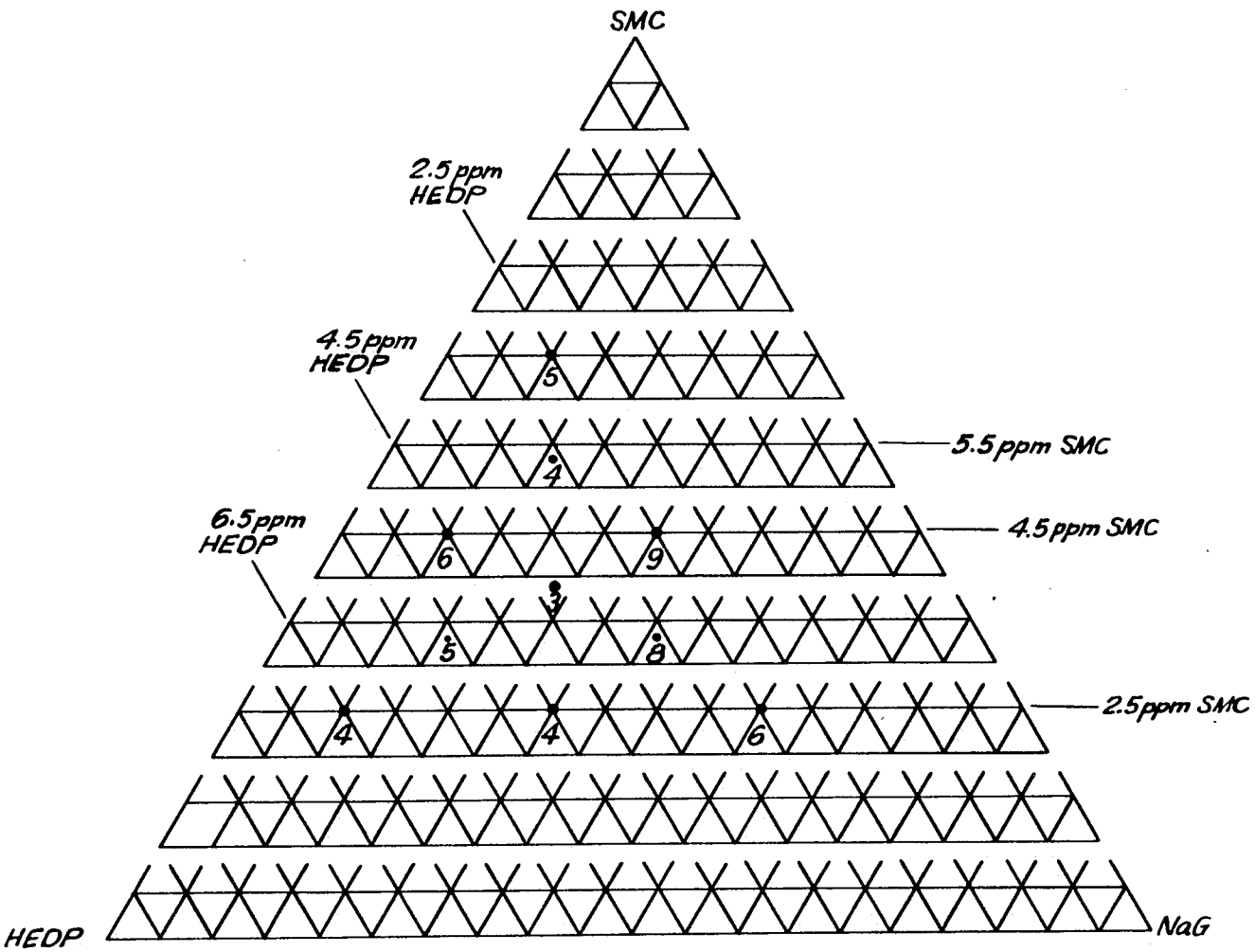
FIG. 1 is a trilinear graph depicting the corrosion rates of mild steel in water containing a combination of inhibiting ingredients including sodium molybdate.

Therefore, it is an object of the present invention to provide a novel inhibitor of corrosion of metallic surfaces in aqueous media having a variety of uses such as cooling water, antifreezes, metal working fluids, hydraulic fluids, chemical cleaning solutions, etc.

It is another object of the present invention to provide molybdate:gluconate compounds as novel inhibitors of metallic surface corrosion in aqueous systems.

It is another object of the present invention to provide novel corrosion inhibitors of ferrous metal surfaces in the complexes of molybdenum oxide and sodium gluconate.

It is a still further object of the present invention to provide a novel process for synthesizing organomolybdenum corrosion inhibitors.

Finally, it is the object of the present invention to provide a novel organomolybdenum compound with anticorrosion properties which are at least equal if not superior to others, such as sodium molybdate, while being significantly more economical to produce.

DETAILED DESCRIPTION OF THE INVENTION

The novel corrosion inhibitor is the reaction product of molybdic oxide with sodium gluconate. The reactants are mixed in water and, after a short time, form a new compound as characterized by its melting point range being lower than either reactant; its water solubility being significantly higher, and its structural infrared spectrogram being significantly different than either reactant. Chemical analysis suggests that the compound can be represented by the formula $MoO_3$:NaG:$H_2O$. While not wishing to be bound to defining the structure of the novel compound nor the type of bonding between molybdenum and gluconate species, we think that a complex is formed between the oxy-molybdenum and one or more hydroxyl groups of the gluconate structure.

We have found that aqueous solutions of the compound efficiently inhibit the corrosion of ferrous metal or alloy and also inhibit copper corrosion.

The product compound is synthesized in aqueous solution using as reactants molybdic oxide and alkali or alkaline earth gluconates, or ammonium gluconate. The reactants are stirred together in the presence of water to form a colorless, clear solution. Reaction time is indefinite, but is effected quickly, normally in 30 minutes or less at temperatures which may range from about 20° C. to about less than 80° C. Sufficient water must be present to effect complete solubilization of the reactants and product. Typically, the water must exceed about 20% by weight of the weight of the reactants.

The reactants are utilized at a weight ratio of from 1:1 to 1:9, respectively, to achieve a product having both effective corrosion inhibiting performance and economic viability. According to our preferred embodiments, optimum corrosion inhibiting performance at minimal reactant materials cost is achieved using the reactants at weight ratios of from 1:3 to 1:5, respectively.

While it is possible to use the novel compound thus formed as a corrosion inhibitor while still in its aqueous solution form, the compound may also be recovered as a crystalline product for subsequent and later dissolution and use as a corrosion inhibitor.

The solid, crystalline product may be recovered from its aqueous solution through conventional means such as evaporative crystallization, crystallization from its supersaturated solution, vacuum drying, spray drying, etc. The crystals are white and non-hygroscopic. The crystalline product obtained after reaching $MoO_3$ and sodium gluconate in aqueous solution at a weight ratio of 1:5 has a melting point range of about 84° to 97° C. and water solubility of about 65 grams in 100 grams $H_2O$.

Other substances can be incorporated within the aqueous solution prior, during or after formation of the molydategluconate compound without circumvention of the invention. These other substances may be incorporated to further enhance inhibitor performance, reduce cost by acting as a diluent, or to alter the appearance of solution or recovered crystalline product.

CORROSION INHIBITING BEHAVIOR OF A PREFERRED EMBODIMENT:

A preferred embodiment of the present invention is the molybdate-gluconate compound which is an efficient corrosion inhibitor. The laboratory test results of this compound based on the average corrosion weight loss of mild steel specimens immersed in a corrosive, aerated, low hardness water of pH 8.5 at 120° F. (49° C.) for 48 hours are shown in the following table (Table 1).

Surprisingly, we observed that the molybdate-gluconate compound was as efficient as an equal concentration of sodium molybdate dihydrate in inhibiting the corrosion of mild steel but required a much lower quantity of Mo to produce the corrosion inhibiting effect. In this context, it is important to note that the production cost of this molybdate-gluconate compound is only one-half that of sodium molybdate based on figures available at present; clearly, a considerable advantage for the novel corrosion inhibitor exists as to production cost and concomitant benefit.

TABLE 1

| Inhibitor | Concentration, mg/L[3] | Mild Steel Corrosion Rate. mpy[1] |
|---|---|---|
| None | — | 82 |
| Sodium Gluconate | 500 | 51 |
| Sodium Molybdate Dihydrate | 500 | 26 |
| Molybdate-Gluconate[2] | 500 | 24 |

[1]mpy = mils per year
[2]Reaction product of 1 weight part molybdic oxide with 5 weight parts sodium gluconate.
[3]mg/L = milligrams per liter Within the cooling water industry, electrochemical results are not usually considered conclusive to document the efficacy of inhibitors or inhibitor formulations. Electrochemical tests which were conducted, however, confirmed effective corrosion inhibition for compounds of the invention. Gravimetric (weight loss) measurements in simulated systems are preferred procedures by most users. The Spinner Test Apparatus has been used here for gravimetric inhibitor testing in simulated cooling water systems.

Spinner Test Apparatus

The "spinner test" apparatus consisted of a specimen support which held four individual mild steel specimens immersed in a glass tank holding 16 liters of corrosion medium, usually water. The specimen support rotated with very little eccentricity at 75 rpm by an electric motor to produce a media flow rate of 0.4 m/s (1.3 f/s) across the surface of the test specimens. The test solution was maintained at 120° F. by an immersion heater and was fully saturated with air by a glass gas sparger. The average weight loss of the four specimens is determined after a minimum of 48 hours immersion, calculated in mils per year (mpy), and reported in Table 1 herein.

Experimental Results

A minimum of seven spinner tests were made for each system for which mild steel corrosion rates in mils per year (mpy) were determined at concentrations specified by the simplex design and then displayed on trilinear graph paper. The evaluation of organomolybdenum compounds of the invention as corrosion inhibitors was conducted with the usual co-ingredients in the formulation as described for FIG. 1; that is, with $ZnSO_4.H_2O$ (Zn), Sodium Tolyltriazole (NaTT), and 1-Hydroxyethylidene-1,1-Diphosphonic Acid (HEDP). In addition, sodium gluconate (NaG) was also evaluated as a 5th component. Since these formulations are complex multicomponent mixtures, a statistical technique was used so these systems could be characterized with minimum experimentation. The statistical technique is called the simplex design and involves displaying the weight loss measurements (mpy) on trilinear graph paper. With a minimum of seven specific experimental points, the simplex design generates a mathematical model which can predict the metal corrosion in mils per year (mpy) for all compositions of the formulation.

It was the objective of this work to carry out a simplex design for the Base System: $Na_2MoO_4.2H_2O$(SMC)-Zn-NaTT-HEDP, and then to use those results as the basis for comparing and evaluating organometallic compounds of the invention when substituted for SMC in the Base System. experimental region of a three-component mixture system, and since our systems had four or five components, the concentration of one or two components was held constant for all the tests completed during this work. In addition, although the compositions of three components were varied, the total concentration of the four or five components of the inhibitor formulation remained constant at about 14 to 15 ppm. Thus the sum concentration of the three variable components was 9 ppm at any point on the trilinear graph.

Trilinear graph treatment of the measured corrosion rates (mpy) for the SMC-Zn-NaTT-HEDP-NaG system showed a number of trends. SMC herein means Sodium Molybdate Crystalline having the formula $Na_2MoO_4.2H_2O$. Thus, as Zn in the system increased, corrosion inhibition improved, i.e., corrosion rate decreased. In fact, the corrosion rate dropped below 10 mpy as the Zn concentration increased to about 1 ppm. Below 1 ppm Zn, the corrosion rate was about 10 mpy and at or above 1.5 ppm Zn the corrosion rate was 3 to 4 mpy. In addition, at constant concentration of SMC, i.e., 3 ppm or 5 ppm, increased concentration of Zn (at the expense of NaTT) also decreased the corrosion rate. Varying the concentration of either SMC or NaTT had little or no effect on corrosion rate. FIG. 1 shows a trilinear plot of corrosion rates for the SMC-HEDP-NaG system with $Zn_{2+}$ fixed at 0.91 ppm (2.5 ppm $ZnSO_4.H_2O$) and NaTT fixed at 2 ppm. The data show all single digit corrosion rates.

Figure 2:
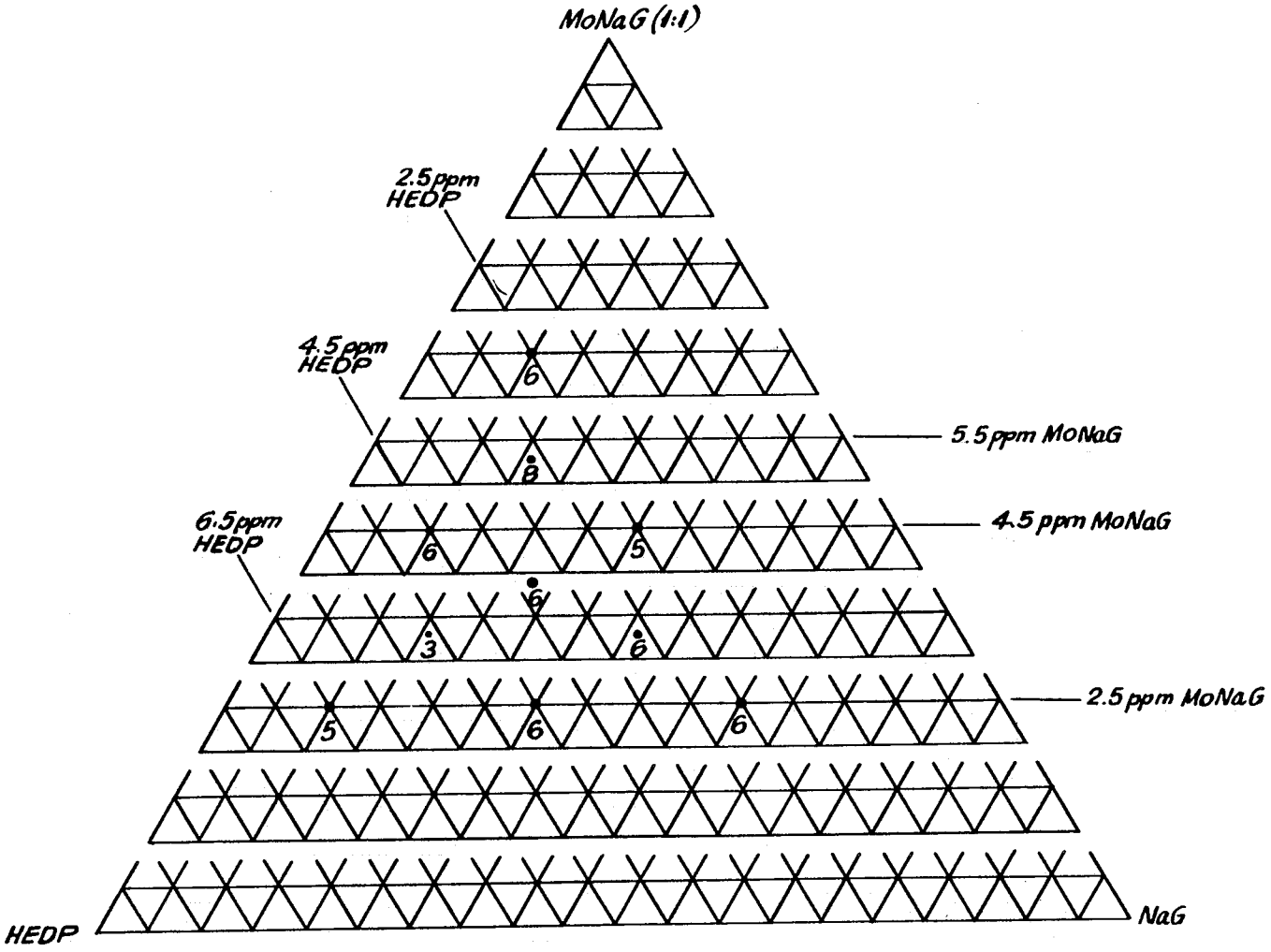
FIG. 2 is a trilinear graph depicting the corrosion rates of mild steel in water containing a combination of inhibiting ingredients including a new molybdenum carboxylic compound.

FIG. 2 shows similar trilinear graph of corrosion rates for the molybdic oxide: sodium gluconate (1:1)-HEDP-NaG system with Zn and NaTT fixed as in FIG. 1. Again, all corrosion rates are single digit and are very close to those obtained using SMC in the same system.

Figure 3:
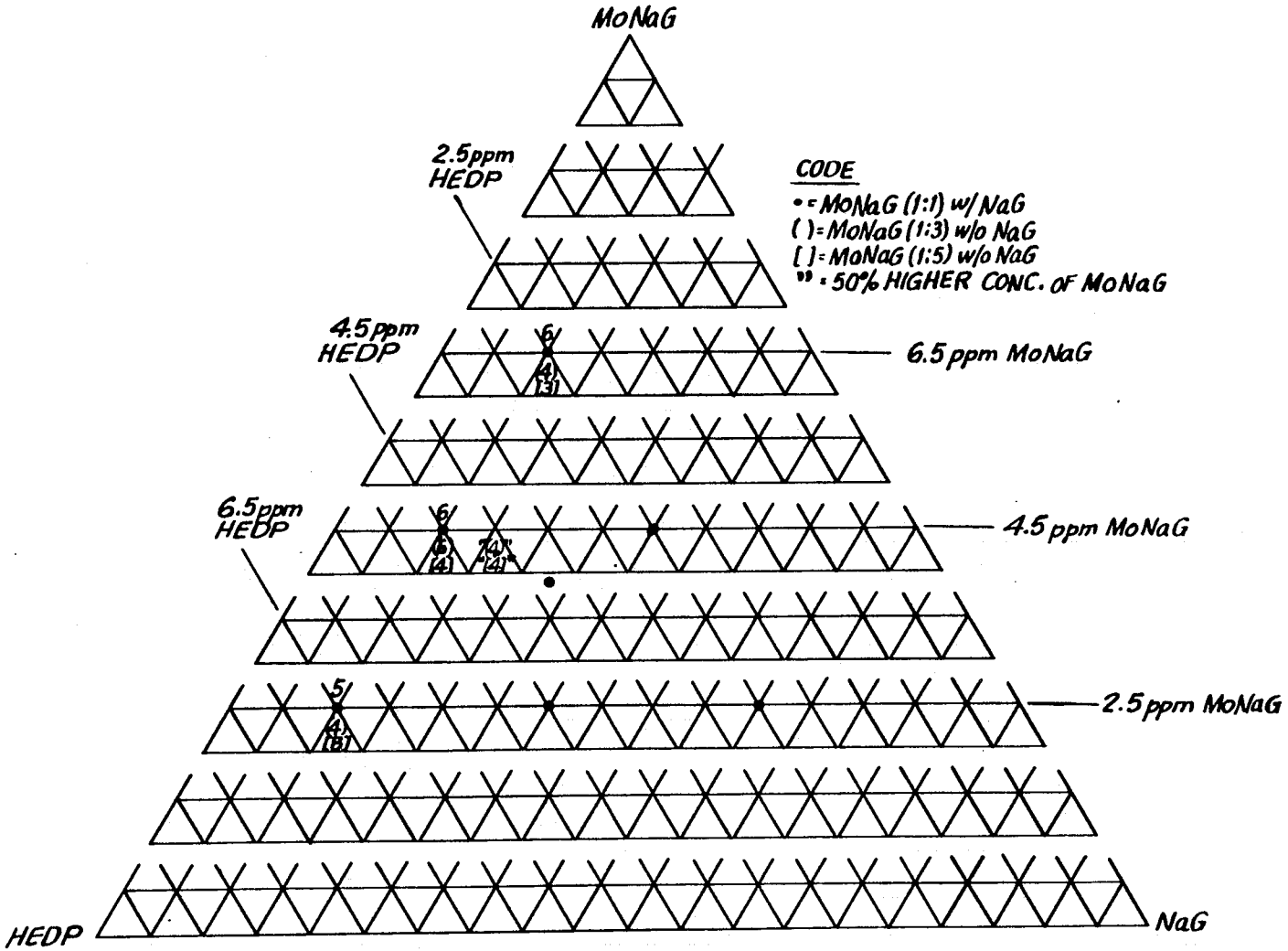
FIG. 3 is a trilinear graph similar to that of FIG. 2 but including results using several of the new molybdenum carboxylic compounds.

FIG. 3 is similar to FIG. 2 except that it also includes data for molybdic oxide:sodium gluconate 1:3 and 1:5 as well as 1:1. All conditions provided single digit corrosion rates. $MoO_3$:Na G(1:5) gave results equivalent to those obtained using sodium molybdate but with substantial and quite unexpected reduction in Mo requirement.

Similar tests using molybdenum citrate derivatives instead of molybdenum oxide:sodium gluconate showed poorer performance.

EXAMPLES

Mild steel specimens (AISI-1010) were supplied by Q-Panel Co. (Cleveland, Ohio). Table 2 gives the names and suppliers of individual inhibitors used in the formulations. Other undesignated chemicals were either reagent grade or were synthesized using molybdic oxide (POM grade from Climax Molybdenum Company).

TABLE 2

Chemicals Used to Prepare Corrosion Inhibitor Formulations

| Chemical | Trade Name | Supplier |
|---|---|---|
| Sodium molybdate dihydrate | Sodium Molybdate Crystalline (SMC) | Climax Molybdenum Co. |
| 1-hydroxyethylidene-1, 1-diphosphonic acid (60% active) | Dequest 2010 | Monsanto Corp. |
| Sodium tolyltriazole (50% active) | Cobratec TT-50S | PMC Specialties Group |
| Zinc sulphate monohydrate | zinc sulphate | Sherwin-Williams Co. |
| Sodium gluconate | sodium gluconate | Pfizer |

Table 3 summarizes some remaining physical and chemical property comparisons of compounds of the invention which we termed MOR-X 113 ($M_oO_3$:3NaG:3$H_2O$) and MOR-X 115 ($M_oO_3$:5$N_a$G:5$H_2O$) to SMC. Three stability test comparisons were made. The first was a concentrated formulation in distilled water containing 5 percent Dequest 2010 (60 percent HEDP), 5 percent of the indicated Mo compound (SMC, MOR-X 113, or MOR-X 115), and 2 percent $ZnSO_4$.$H_2O$. These concentrate solutions were put in a closed bottle at their natural pH and allowed to sit in natural Colorado sunlight. After 2 weeks, they all remained clear. After 1 month, the SMC developed a precipitate, while both MOR-X concentrates stayed clear. MOR-X 115 developed a precipitate after 2 months, while MOR-X 113 did not precipitate after 3 months, although it turned yellow after 2 months. The yellow was probably caused by some decomposition in the hot sunlight.

The second stability test was a hard water stability determination where a formulation was made up in hard water (1,000 ppm $CaCO_3$ as $CaCl_2$). The formulation was 5 ppm Dequest 2010, 5 ppm of the indicated Mo compound (SMC, MOR-X 113, or MOR-X 115), 2 ppm $ZnSO_4$.$H_2O$, and 2 ppm Cobratec TT-50-S. The pH was adjusted to 8.5 with sodium hydroxide. The data show that after 3 months, all three solutions remained clear, indicating no difference between SMC and the MOR-X compounds for hard water stability Previous tests in the spinner apparatus indicated that MOR-X compounds are probably more hard water stable than SMC because of the sequestering property of the gluconate ligand. SMC will tend to precipitate as calcium molybdate.

The third stability test was a thermal stability determination. Here a similar formulation to the one used in the hard water stability determination was prepared using soft water as the diluent and solvent, put in a closed bottle at pH 8.5, and heated to 120° to 150° F. in an oven. After 6 weeks, the MOR-X-containing solutions were still clear, while the SMC-containing solution had turned turbid. The MOR-X-containing solutions remained stable without decomposition of the organic part, while after 6 weeks the SMC was apparently beginning to react with the calcium in solution.

Table 3 also shows the chemical (Mo and Na) analysis of MOR-X 113 and MOR-X 115. When the analysis of MOR-X 113 is compared to the theoretical analysis with 3 waters of hydration, the composition balances reasonably well. Similarly, when the chemical analysis of MOR-X 115 is compared to the theoretical analysis with 5 waters of hydration, the composition also balances reasonably well. It appears that the crystalline MOR-X product carries waters of hydration equivalent to the molar ratio of gluconate to Mo.

Finally, Table 3 shows the thermal gravimetric analysis (TGA) of MOR-X 113. The weight loss at temperatures below 170° C. (338° F.) was only 0.33 percent at 100 C (212° F.). Between 170 and 264° C. (338° and 507° F.), an additional 44.5 percent weight loss was measured. No additional weight loss occurred between 264° and 400° C. (507° and 752° F.). Clearly, the compound remained stable up to 170° C. (338° F.) and then began losing waters of hydration and decomposing simultaneously to 264° C. (507° F.). The weight loss of 44.5 percent is equivalent to loss of all the waters of hydration plus decomposition of 67 percent of the gluconate ligand.

TABLE 3

Chemical and Physical Properties of MOR-X and MOR-X Formulations

Stability of MOR-X Formulations 1. 5% Dequest 2010, 5% Mo Compound, 2% $ZnSO_4$. $H_2O$ in deionized water. No pH adjustment.

| | pH | Solution Appearance 2 Weeks | 1 Month | 2 Months | 3 Months |
|---|---|---|---|---|---|
| MOR-X 115 | 2.5 | clear | clear | ppt | ppt |
| MOR-X 113 | 0.6 | clear | clear | yellow | yellow |
| SMC | 0.6 | clear | ppt | ppt | ppt |

2. Hard Water Stability: 5 ppm Dequest 2010, 5 ppm Mo Compound, 2 ppm Mo Compound, 2 ppm $ZnSO.H_2O$, 2 ppm Cobratec TT-50-S in water containing 1000 ppm $CaCO_3$ as $CaCl_2$. pH adjusted to 8.5.

| | pH | Solution Appearance 1 Month | 2 Month | 3 Months |
|---|---|---|---|---|
| MOR-X 115 | 8.5 | clear | clear | clear |
| MOR-X 113 | 8.5 | clear | clear | clear |
| SMC | 8.5 | clear | clear | clear |

3. Thermal Stability (120 to 150° F.): 5 ppm Dequest 2010, 5 ppm Mo Compound, 2 ppm $ZnSO_4.H_2O$, 2 ppm Cobratec TT-50-S in water containing 40 ppm $CaCO_3$ as $CaCl_2$. pH adjusted to 8.5.

| | pH | Solution Appearance 2 Weeks | 4 Weeks | 6 Weeks |
|---|---|---|---|---|
| MOR-X 115 | 8.5 | clear | clear | clear |
| MOR-X 113 | 8.5 | clear | clear | clear |
| SMC | 8.5 | clear | clear | turbid |

Chemical Analysis

| | % Mo | % Na |
|---|---|---|
| MOR-X | 11.0 | 9.5 |
| $MoO_3$:3NaG:3$H_2O$ (Theoretical) | 11.3 | 8.1 |
| MOR-X 115 | 7.4 | 9.1 |
| MoO3:5NaG:5$H_2O$ (Theoretical) | 7.2 | 8.7 |

Thermal Gravimetric Analysis (TGA) of MOR-X 113

| Temperature | Weight Loss (accumulative) |
|---|---|
| 100° C. | 0.33% |

TABLE 3-continued

Chemical and Physical Properties of MOR-X and MOR-X Formulations

Stability of MOR-X Formulations

| | |
|---|---|
| 170–264° C. | 44.5% |
| 400° C. | 44.5% |

The MOR-X compounds can also be cosynthesized with another corrosion inhibitor such as DBA (a dibasic acid produced by DuPont having as principal components glutaric, succinic and adipic acids) to produce a pale yellow solution and resulting crystals upon drying. The melting point of MOR-X 115 crystals with 20% DBA content ranges from 66° to 92° C. and their water solubility is greater than 60% at room temperature. In comparison, the melting points of SMC and sodium gluconate are 686 C and 200° C., respectively, while their solubilities are 40% and 37%, respectively.

Corrosion tests were conducted on copper specimens since copper components are frequently included in cooling water system. The results obtained are shown in Table 4.

TABLE 4

Comparisons of Copper Corrosion

| Test No.[a] | Test Duration, Days | Mo Compound | Formulation, mg/L: Mo Compound | Dequest 2010 | $ZnSo_4.H_2O$ | Cobratec TT-50-S | Corrosion Rate, mpy |
|---|---|---|---|---|---|---|---|
| 1 | 2 | None | 0 | 0 | 0 | 0 | 0.34 |
| 2 | 28 | None | 0 | 0 | 0 | 0 | 0.07 |
| 3 | 56 | None | 0 | 0 | 0 | 0 | 0.30 |
| 4 | 2 | SMC | 500 | 0 | 0 | 0 | 0.09 |
| 5 | 28 | SMC | 500 | 0 | 0 | 0 | 0.25 |
| 6 | 56 | SMC | 500 | 0 | 0 | 0 | 0.31 |
| 7 | 2 | MOR-X 115 | 500 | 0 | 0 | 0 | 0.05 |
| 8 | 28 | MOR-X 115 with DBA | 500 | 0 | 0 | 0 | 0.70 |
| 9 | 56 | MOR-X 115 with DBA | 500 | 0 | 0 | 0 | 0.94 |
| 10 | 28 | MOR-X 115 with DBA | 25 | 5 | 2 | 2 | 0.01 |
| 11 | 56 | MOR-X 115 with DBA | 25 | 5 | 2 | 2 | 0.01 |
| 12 | 2 | SMC | 10 | 10 | 2 | 2 | 0.06 |
| 13 | 2 | MOR-X 115 | 10 | 10 | 2 | 2 | 0.13 |
| 14 | 2 | SMC | 10 | 10 | 2 | 0 | 0.12 |
| 15 | 2 | MOR-X 115 | 10 | 10 | 2 | 0 | 0.14 |

[a]Standard test conditions: 120° F., pH = 8.5, forced aeration, copper coupons, soft corrosive water (40 mg/L Ca as $CaCO_3$, 250 mg/L $Cl^-$, 520 mg/L $SO_4^{-2}$, 125 mg/L alkalinity as $CaCO_3$).

Heat flux corrosion tests were also conducted using a modification of apparatus described in the ASTM D-4340 test method and substituting AISI 1010 steel for the aluminum in the standard method as the heat rejecting metal specimen. At a heat flux level of about 1000 Btu/hour-ft$^2$, the organomolybdenum compound of the invention (MOR-X 115) showed no significant visible evidence of decomposition over 20 days. Solution appearance and corrosion test results are shown in Table 5.

TABLE 5

Heat Flux Corrosion Test Results

| Test No.[a] | Mo Compound | Formulation, mg/L: Mo Compound | HEDP | $ZnSO_4.H_2O$ | Cobratec TT-50-S | Test Duration (Days) | pH Initial | pH Final | Solution Condition | Corrosion Rate, mpy |
|---|---|---|---|---|---|---|---|---|---|---|
| 1 | None | 0 | 0 | 0 | 0 | 20 | 8.5 | 9.1 | Brown, Cloudy | 14 |
| 2 | SMC | 20 | 10 | 2 | 2 | 20 | 8.5 | 9.3 | Yellow, Cloudy | 12 |
| 3 | MOR-X 115 | 20 | 10 | 2 | 2 | 20 | 8.5 | 9.5 | Clear, Slightly Yellow | 6 |
| 4 | MOR-X 115 with DBA | 20 | 10 | 2 | 2 | 20 | 8.5 | 9.3 | Clear, Slightly Yellow | 10 |
| 5 | None | 0 | 0 | 0 | 0 | 2 | 8.5 | 9.1 | Brown, Cloudy | 70 |
| 6 | SMC | 20 | 5 | 2 | 2 | 2 | 8.5 | 8.0 | Clear, Colorless | 23 |
| 7 | MOR-X 115 | 20 | 5 | 2 | 2 | 2 | 8.5 | 7.6 | Clear, Colorless | 21 |

[a]Experimental conditions: temperature of hot surface = 180° F. (controlled), temperature of test fluid = 148° F. (measured), forced aeration, mild steel coupons (AISI 1010).

Figure 4A:
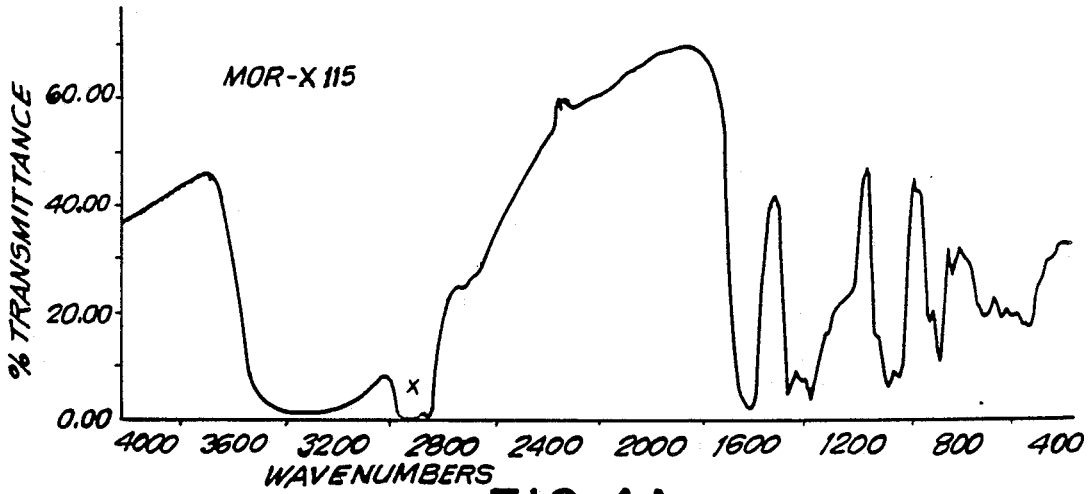
FIG. 4 depicts graphs showing infrared spectra of the new molybdenum carboxylic compound compared to infrared spectra of its component compounds.
Figure 4B:
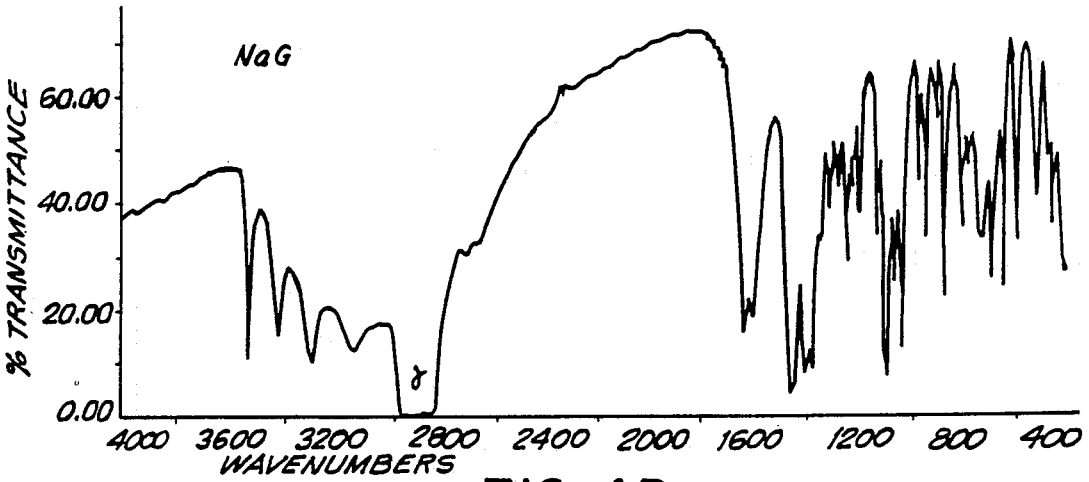
Figure 4C:
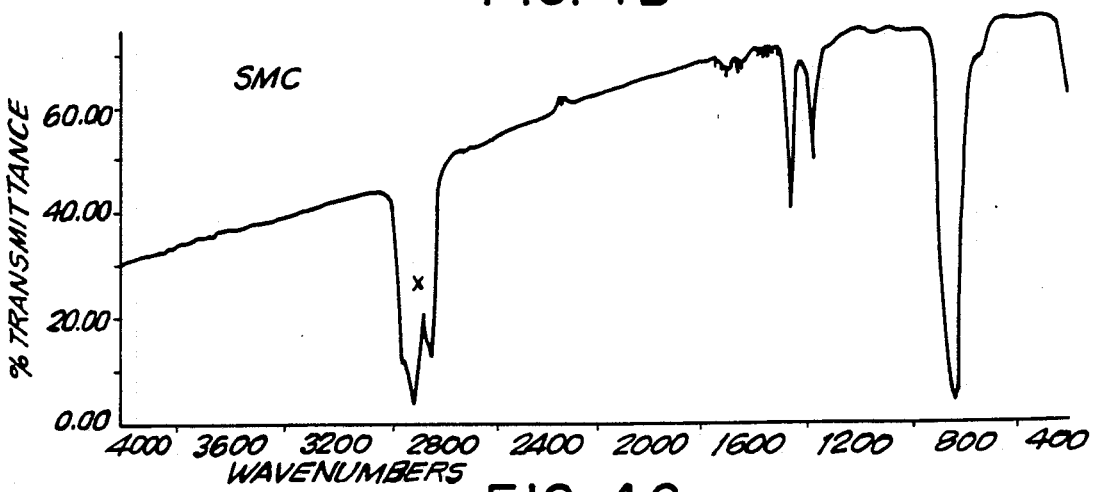

As noted previously herein, the molybdenum carboxylate compounds of the invention appear to be new compounds in terms of melting point, solubility and infrared spectrum in terms of the compounds from which they are derived. FIG. 4 of the drawing shows in tracing "A" the infrared spectrum of $MoO_3$:5NaG:5-$H_2O$ with spectra for sodium gluconate (NaG) and sodium molybdate being shown in tracings "B" and "C", respectively. The peaks marked "x" are due to water. Sodium molybdate has only one peak while NaG has about 27 peaks. The compound of the invention has only about 10 peaks which do not resemble those for SMC or NaG.

Although the present invention has been described in conjunction with preferred embodiment, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The method of preparing an organomolybdenum compound useful as a corrosion inhibitor of metallic surfaces exposed to aqueous media which comprises reacting molybdic oxide with sodium gluconate in aqueous solution with heating and stirring at atmospheric pressure to achieve dissolution to produce a compound which, upon recovery by vacuum drying occurs as solid, white, non-hygroscopic crystals.

2. The method in accordance with claim 1 wherein said molybdic oxide and sodium gluconate are reacted in weight ratio of about 1:1 to about 1:9.

3. The method in accordance with claim 1 wherein said molybdic oxide and said sodium gluconate are reacted in a weight ratio of about 1:5 and the resulting compound, upon vacuum distillation, has a melting point range of about 84° to 97° C. and a water solubility of about 55 grams in 100 grams $H_2O$.

4. A corrosion-inhibiting organomolybdenum compound made by reacting molybdic oxide with sodium gluconate in aqueous solution at a weight ratio of about 1:5 with heating and stirring at atmospheric pressure for a time sufficient to achieve dissolution, said compound, upon vacuum drying, having a melting point range of about 84° to 97°C., a water solubility of about 55 grams in 100 grams $H_2O$; and an occurrence as solid, white, non-hygroscopic crystals.

5. The method for inhibiting corrosion of metallic surfaces in contact with water which comprises including in said water an effective amount of an organomolybdenum compound made by reacting molybdic oxide with sodium gluconate in aqueous solution to form a compound which, upon vacuum drying, occurs as solid, white, nonhygroscopic crystals.

6. The method in accordance with claim 5 wherein said organomolybdenum compound is made by reacting molybdic oxide and sodium gluconate in a weight ratio of from 1:1 to 1:9.

7. The method in accordance with claim 5 wherein said organomolybdenum compound is made by reacting molybdic oxide and sodium gluconate in a weight ratio of about 1:5 to produce a compound which upon vacuum drying, occurs as solid, white, nonhydroscopic crystals having a melting point range of about 84 to 97° C. and a water solubility of about 55 grams in 100 grams $H_2O$.

8. The method in accordance with claim 5 wherein said molybdic oxide and said sodium gluconate are reacted in a weight ratio of about 1:3 to about 1:5.

9. The method in accordance with claim 5 wherein said metallic surface is a steel surface.

* * * * *